US008482469B2

(12) United States Patent
Ayala et al.

(10) Patent No.: US 8,482,469 B2
(45) **Date of Patent: *Jul. 9, 2013**

(54) ANTENNAS AND ANTENNA CARRIER STRUCTURES FOR ELECTRONIC DEVICES

(75) Inventors: Enrique Ayala, Watsonville, CA (US); Gregory Allen Springer, Sunnyvale, CA (US); Douglas B. Kough, San Jose, CA (US); Matthew Ian McDonald, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/607,575

(22) Filed: Sep. 7, 2012

(65) Prior Publication Data

US 2013/0002494 A1 Jan. 3, 2013

Related U.S. Application Data

(63) Continuation of application No. 12/142,744, filed on Jun. 19, 2008, now Pat. No. 8,264,412.

(60) Provisional application No. 61/019,218, filed on Jan. 4, 2008.

(51) Int. Cl.
*H01Q 1/24* (2006.01)

(52) U.S. Cl.
USPC ..... 343/702; 343/700 MS

(58) Field of Classification Search
USPC ..... 343/702, 700 MS, 846
See application file for complete search history.

(56) References Cited

U.S. PATENT DOCUMENTS

| | | | | |
|---|---|---|---|---|
| 5,258,892 | A | 11/1993 | Stanton et al. | |
| 5,608,413 | A | 3/1997 | Macdonald | |
| 6,272,356 | B1 | 8/2001 | Dolman et al. | |
| 6,307,512 | B1 | 10/2001 | Geeraert | |
| 6,380,899 | B1 * | 4/2002 | Madsen et al. | 343/702 |

(Continued)

FOREIGN PATENT DOCUMENTS

| | | |
|---|---|---|
| EP | 1 739 785 | 1/2007 |
| WO | 2005 120164 | 12/2005 |

OTHER PUBLICATIONS

"AirPort Product-Specific Details", AirPort Developer Note, [Online], Updated: Apr. 28, 2008, Retrieved: Sep. 25, 2008, <http://developer.apple.com/documentation/HardwareDrivers/Conceptual/HWTech_Airport/Articles/AirP_implementation.html>.

(Continued)

*Primary Examiner* — Hoanganh Le
(74) *Attorney, Agent, or Firm* — Treyz Law Group; G. Victor Treyz; David C. Kellogg

(57) ABSTRACT

Antenna support structures and antennas are provided for wireless electronic devices such as portable electronic devices. Antenna resonating elements may be formed from conductive coatings on two-shot molded interconnect device dielectric antenna support structures. The conductive coatings may be formed from wet-plated copper or other conductive materials. The antenna support structure may have tabs that electrically connect antenna resonating elements to the case of a wireless electronic device that serves as an antenna ground plane. The antenna support structure may be curved about its longitudinal axis so that the antenna resonating elements on the support structure protrude upwards to enhance antenna performance. In a portable electronic device such as a portable computer, the antenna support structure may be mounted within a dielectric portion of the computer housing that is located between the display portion of the housing and the base of the housing.

23 Claims, 11 Drawing Sheets

U.S. PATENT DOCUMENTS

| | | | | |
|---|---|---|---|---|
| 6,392,605 | B2 | 5/2002 | Anterow | |
| 6,392,610 | B1 | 5/2002 | Braun et al. | |
| 6,414,643 | B2 | 7/2002 | Cheng et al. | |
| 6,421,029 | B1 | 7/2002 | Tanabe | |
| 6,448,942 | B2 | 9/2002 | Weinberger et al. | |
| 6,539,608 | B2 | 4/2003 | McKinnon et al. | |
| 6,570,538 | B2 | 5/2003 | Vaisanen et al. | |
| 6,636,181 | B2 | 10/2003 | Asano et al. | |
| 6,667,719 | B2 | 12/2003 | LaKomski | |
| 6,781,546 | B2 | 8/2004 | Wang et al. | |
| 6,791,506 | B2 | 9/2004 | Suganthan et al. | |
| 6,819,287 | B2 | 11/2004 | Sullivan et al. | |
| 6,847,329 | B2 | 1/2005 | Ikegaya et al. | |
| 6,861,989 | B2 | 3/2005 | Morningstar et al. | |
| 7,181,172 | B2 | 2/2007 | Sullivan et al. | |
| 7,183,983 | B2 | 2/2007 | Ozden | |
| 7,339,530 | B2 * | 3/2008 | Ying et al. | 343/702 |
| 7,447,530 | B2 | 11/2008 | Iwai et al. | |
| 7,705,789 | B2 | 4/2010 | Suzuki et al. | |
| 7,916,089 | B2 * | 3/2011 | Schlub et al. | 343/702 |
| 8,264,412 | B2 * | 9/2012 | Ayala et al. | 343/702 |
| 2001/0040529 | A1 | 11/2001 | Cheng | |
| 2002/0024469 | A1 | 2/2002 | Masaki | |
| 2002/0163473 | A1 | 11/2002 | Koyama | |
| 2003/0222823 | A1 | 12/2003 | Flint et al. | |
| 2004/0219956 | A1 | 11/2004 | Iwai et al. | |
| 2004/0257283 | A1 | 12/2004 | Asano et al. | |
| 2005/0062657 | A1 | 3/2005 | Lin | |
| 2006/0158379 | A1 | 7/2006 | Ishimiya | |
| 2007/0126651 | A1 | 6/2007 | Snyder et al. | |
| 2007/0140072 | A1 | 6/2007 | Agrawal et al. | |
| 2008/0018542 | A1 | 1/2008 | Yamazaki et al. | |
| 2008/0166004 | A1 | 7/2008 | Sanford et al. | |
| 2009/0153411 | A1 | 6/2009 | Chiang et al. | |
| 2009/0174611 | A1 | 7/2009 | Schlub et al. | |
| 2009/0243943 | A1 | 10/2009 | Mumbru et al. | |
| 2009/0273529 | A1 | 11/2009 | Liu | |
| 2010/0073242 | A1 | 3/2010 | Ayala Vazquez et al. | |

OTHER PUBLICATIONS

Bancroft, "A Commercial Perspective on the Development and Integration of an 802.11albig HiperLanNVLAN Antenna into Laptop Computers" Centurion Wireless Technologies, IEEE: ArtOntlas end Propagvtion itlarreeino. vol. 48. No. 4, Aug. 2005.

Wikipedia contributors, "MacBook Pro," Wikipedia, The Free Encyclopedia, [online] <http://en.wikipedia.org/w/index.php?title=MacBook_Pro&oldid=506131750>, retrieved Aug. 7.

Eisenman, Ben, "Installing MacBook Pro 15" Core 2 Duo Model A1211 Antenna Cables, ifixit, [online], Nov. 2009, retrieved Aug. 7, 2012, links below.

<http://www.ifixit.com/Guide/Installing-MacBook-Pro-15-Inch-Core-2-Duo-Model-A1211-Antenna-Cables/1438/1>.

<http://www.ifixit.com/Guide/Installing-MacBook-Pro-15-Inch-Core-2-Duo-M odel-A1211-Antenna-Cables/1438/2>.

<http://www.ifixit.com/Guide/Installing-MacBook-Pro-15-Inch-Core-2-Duo-Model-A1211-Antenna-Cables/1438/3>.

<http://www.ifixit.com/Guide/Installing-MacBook-Pro-15-Inch-Core-2-Duo-Model-A1211-Antenna-Cables/1438/4>.

<http://www.ifixit.com/Guide/Installing-MacBook-Pro-15-Inch-Core-2-Duo-Model-A1211-Antenna-Cables/1438/5>.

<http://guide-images.ifixit.net/igi/UjjNajFKmnEfamTb.huge>.

<http://guide-images.ifixit.net/igi/WjZpe3MQt6AEMgne.huge>.

* cited by examiner

ANTENNAS AND ANTENNA CARRIER STRUCTURES FOR ELECTRONIC DEVICES

This patent application is a continuation of patent application Ser. No. 12/142,744, filed Jun. 19, 2008, now U.S. Pat. No. 8,264,412 which claims the benefit of provisional patent application No. 61/019,218, filed Jan. 4, 2008, each of which is hereby incorporated by reference herein in its entirety. This application claims the benefit of and claims priority to patent application Ser. No. 12/142,744, filed Jun. 19, 2008 and to provisional patent application No. 61/019,218, filed Jan. 4, 2008.

BACKGROUND

This invention relates to antennas, and more particularly, to antenna structures and antennas for electronic devices.

Many modern electronic devices use antennas. For example, portable electronic devices are often provided with wireless communications capabilities. Portable electronic devices may use wireless communications to communicate with wireless base stations. As an example, cellular telephones may communicate using cellular telephone bands at 850 MHz, 900 MHz, 1800 MHz, and 1900 MHz (e.g., the main Global System for Mobile Communications or GSM cellular telephone bands). Portable electronic devices may also use other types of communications links. For example, portable electronic devices may communicate using the Wi-Fi® (IEEE 802.11) bands at 2.4 GHz and 5.0 GHz and the Bluetooth® band at 2.4 GHz. Communications are also possible in data service bands such as the 3G data communications band at 2100 MHz band (commonly referred to as UMTS or Universal Mobile Telecommunications System).

To satisfy consumer demand for portable wireless devices, manufacturers are continually striving to reduce the size of components that are used in these devices. For example, manufacturers have made attempts to miniaturize the antennas used in portable electronic devices.

A typical antenna may be fabricated by patterning a metal layer on a circuit board substrate or may be formed from a sheet of thin metal using a foil stamping process. These techniques can be used to produce antennas that fit within the tight confines of a portable device. With conventional portable electronic devices, however, design compromises are made to accommodate compact antennas. These design compromises may include, for example, compromises related to antenna efficiency and antenna bandwidth.

It would therefore be desirable to be able to provide improved antenna structures for electronic devices such as portable electronic devices.

SUMMARY

Wireless communications structures for computers or other electronic devices are provided. The wireless communications structures may include antennas and antenna support structures for antennas.

A portable electronic device such as a portable computer may have a base housing formed from a top case and bottom case. The base housing may be conductive and may serve as an antenna ground plane.

A display housing portion may be mounted to the base housing hinges. A dielectric housing portion that is rigidly connected to the base housing may be located between the base housing and the display housing. A two-shot molded interconnect device dielectric antenna support structure may be mounted within the dielectric housing portion. Three antenna resonating elements may be formed on the antenna support structure.

The antenna resonating elements on the antenna support structure and the antenna ground plane may form three separate antennas for the portable computer. Metal clips may be used to ground transmission lines to tabs associated with the antenna resonating elements. The antenna resonating elements may be connected to the ground plane using screws or other suitable fasteners.

The top case may have a top surface that lies in a plane. The dielectric antenna support structure may have a curved surface on which the antenna resonating elements are formed. The curved surface may protrude above the plane, thereby elevating the antenna resonating element so that the antenna performs well without interference from adjacent metal components.

Further features of the invention, its nature and various advantages will be more apparent from the accompanying drawings and the following detailed description of the preferred embodiments.

DETAILED DESCRIPTION

The present invention relates generally to electronic devices, and more particularly, to antennas for wireless electronic devices.

The wireless electronic devices may be any suitable electronic devices. As an example, the wireless electronic devices may be desktop computers or other computer equipment. The wireless electronic devices may also be portable electronic devices such as laptop computers, tablet computers, or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices may be handheld electronic devices.

Examples of portable and handheld electronic devices include cellular telephones, media players with wireless communications capabilities, handheld computers (also sometimes called personal digital assistants), remote controls, global positioning system (GPS) devices, and handheld gaming devices. The devices may also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
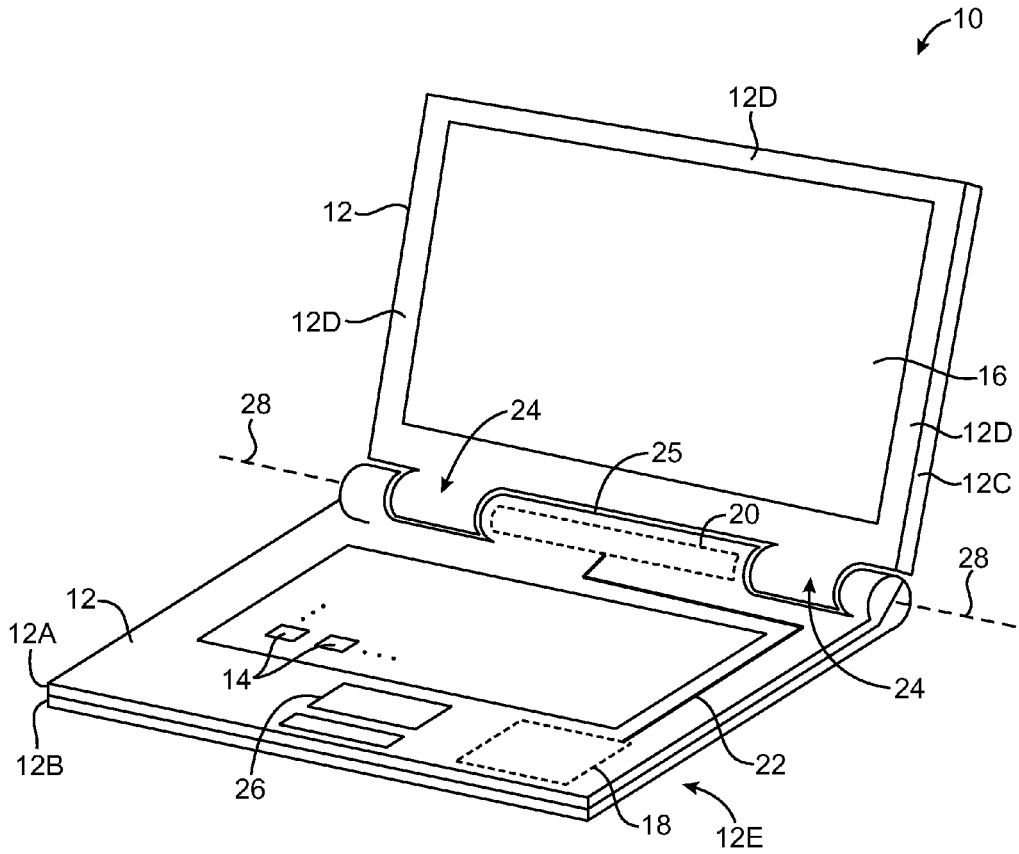
FIG. 1 is a perspective view of an illustrative electronic device such as a portable electronic device in accordance with an embodiment of the present invention.

An illustrative electronic device such as a portable electronic device in accordance with an embodiment of the present invention is shown in FIG. 1. Device 10 may be any suitable electronic device. As an example, device 10 may be a portable computer.

Device 10 may handle communications over one or more communications bands. For example, wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5.0 GHz band that is sometimes used for Wi-Fi communications, the 1575 MHz Global Positioning System band, and 3G data bands (e.g., the UMTS band at 1920-2170). These bands may be covered by using single-band and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5.0 GHz). Two or more multiband antennas of this type may be used in an antenna diversity arrangement. Antenna arrangements with three or more antennas may also be used. For example, device 10 may have two dual-band Wi-Fi antennas and a Bluetooth antenna (as an example).

Device 10 may have housing 12. Housing 12, which is sometimes referred to as a case, may be formed of any suitable materials including plastic, glass, ceramics, metal, other suitable materials, or a combination of these materials. In some situations, portions of housing 12 may be formed from a dielectric or other low-conductivity material, so as not to disturb the operation of conductive antenna elements that are located in proximity to housing 12.

In general, however, housing 12 will be partly or entirely formed from conductive materials such as metal. An illustrative metal housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from conductive elements, one or more of the conductive elements may be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printed circuit board structure used in forming antenna structures for device 10).

As shown in FIG. 1, housing 12 may have a base portion 12E that is formed from two housing portions 12A and 12B. Portion 12A may sometimes be referred to as a top case. Portion 12B may sometimes be referred to as a bottom case. If desired, internal frames may be mounted within housing 12 (e.g., within base portion 12E of housing 12). These internal frames may be used for mounting electronic components such as a battery, printed circuit boards containing integrated circuits and other electrical devices, etc. If desired, printed circuit boards (e.g., a motherboard and other printed circuit boards) and other components may be mounted directly to housing 12. For example, a motherboard may be attached to top case 12A using screws or other fasteners. Upper portion 12C of housing 12 may include a frame 12D that is used to connect a liquid crystal diode (LCD) display 16 or other suitable display into the upper lid (housing) of device 10. Portion 12C may be referred to as the display of device 10 or may be referred to a display housing, a display housing portion, etc.

Display housing portion 12C may be attached to housing base 12E (i.e., the portion of housing 12 that is formed from top case 12A and bottom case 12B) using hinges such as hinges 24.

Housing portion 25 may be located at the rear edge of base 12E between base 12E and display housing 12C. Hinges 24 and housing portion 25 of housing base 12E may have longitudinal axes that are aligned along longitudinal axis 28.

Device 10 may have one or more buttons such as buttons 14. Buttons 14 may be formed on any suitable surface of device 10. In the example of FIG. 1, buttons 14 have been formed on the top surface of device 10. Buttons 14 may form a keyboard on a laptop computer (as an example).

Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16. Device 10 may also have a separate touch pad device such as touch pad 26. An advantage of integrating a touch screen into display 16 to make display 16 touch sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry, and input-output components. Wireless transceiver circuitry in circuitry 18 may be used to transmit and receive radio-frequency (RF) signals. Transmission lines such as coaxial transmission lines and microstrip transmission lines may be used to convey radio-frequency signals between transceiver circuitry and antenna structures in device 10. As shown in FIG. 1, for example, one or more transmission line such as transmission line 22 may be used to convey signals between antenna structure 20 and circuitry 18. Transmission line 22 may be, for example, a coaxial cable that is connected between an RF transceiver (sometimes called a radio) and an antenna. Antenna structures such as antenna structure 20 may be located within housing portion 25 at the rear edge of housing base 12E (i.e., at the juncture between display housing portion 12C and housing base 12E) or may be located in other suitable locations.

Figure 2:
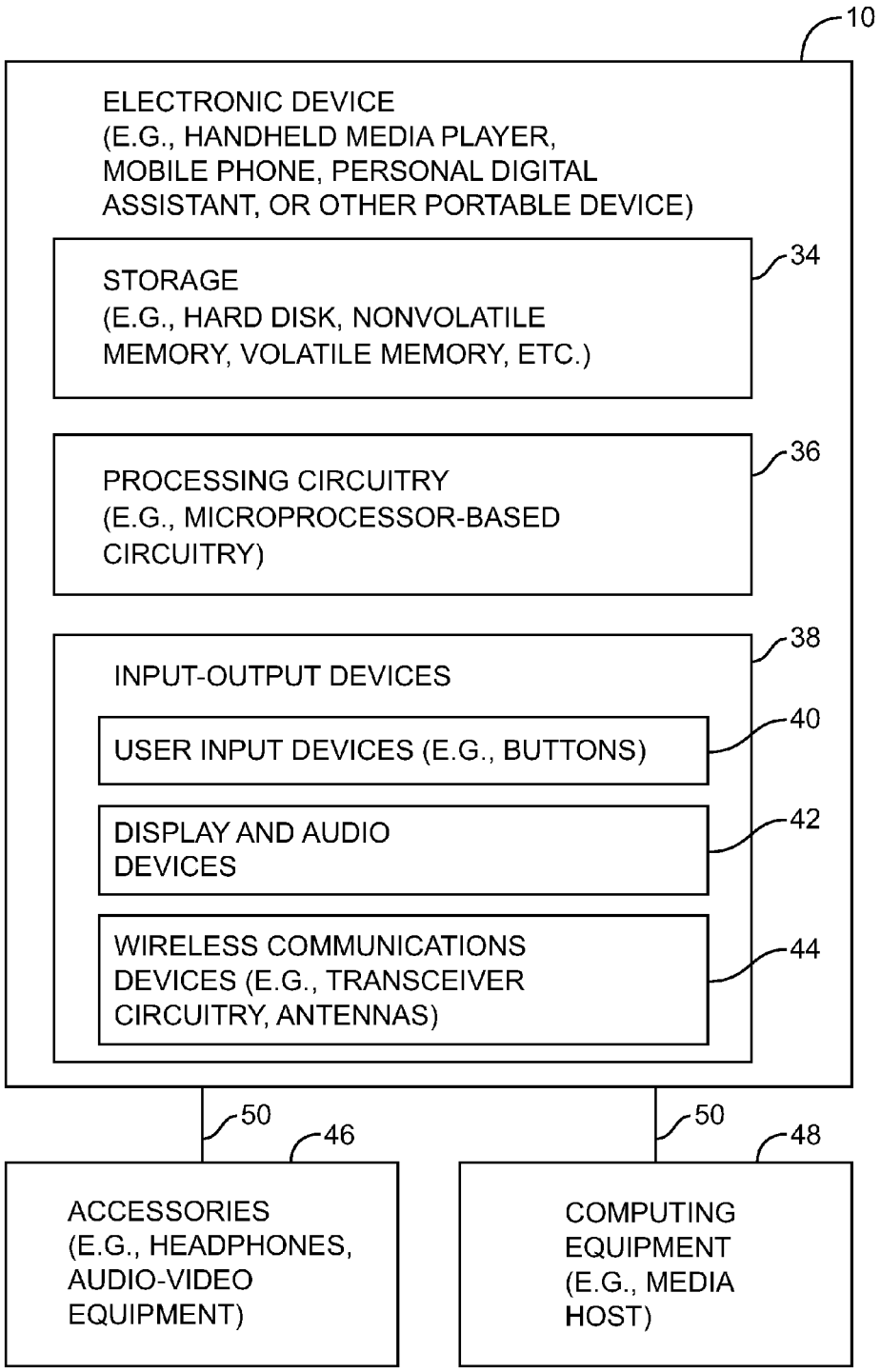
FIG. 2 is a schematic diagram of an illustrative electronic device in accordance with an embodiment of the present invention.

A schematic diagram of an embodiment of an illustrative electronic device such as a portable electronic device is shown in FIG. 2. Device 10 may be a desktop computer, a notebook computer, a mobile telephone, a mobile telephone with media player capabilities, a handheld computer, a remote control, a game player, a global positioning system (GPS) device, a combination of such devices, or any other wireless device such as a portable or handheld electronic device.

As shown in FIG. 2, device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 may be used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, cellular telephone communications protocols, etc.

Input-output devices 38 may be used to allow data to be supplied to device 10 and to allow data to be provided from device 10 to external devices. Display screen 16, keys 14, and touchpad 26 of FIG. 1 are examples of input-output devices 38.

Input-output devices 38 may include user input-output devices 40 such as buttons, touch screens, joysticks, click wheels, scrolling wheels, touch pads, key pads, keyboards, microphones, cameras, speakers, tone generators, vibrating elements, etc. A user can control the operation of device 10 by supplying commands through user input devices 40.

Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas (e.g., antenna structures such as antenna structure 20 of FIG. 1), and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point or an internal or external wireless card that establishes a wireless connection with device 10. The computer may be a server (e.g., an internet server), a local area network computer with or without internet access, a user's own personal computer, a peer device (e.g., another portable electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2100 MHz band (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Wi-Fi bands that may be supported include the 2.4 GHz band and the 5.0 GHz bands. The 2.4 GHz Wi-Fi band extends from 2.412 to 2.484 GHz. Commonly-used channels in the 5.0 GHz Wi-Fi band extend from 5.15-5.85 GHz. Device 10 can cover these communications bands and/or other suitable communications bands with proper configuration of the antenna structures in wireless communications circuitry 44.

Antenna structures such as antenna structure 20 of FIG. 1 may be located at any suitable location in device 10. In configurations in which device 10 has conductive portions (e.g., conductive sidewalls), it may be advantageous to located antenna structure 20 at a position in which antenna structure 20 is not shielded by conductors. This allows the antennas of device 10 to operate freely without being blocked by the conductive portions of device 10.

With one particularly suitable arrangement, which is described herein as an example, antenna structure 20 is located in housing portion 25 of housing base 12E. The remainder of housing base 12E may be formed from top case 12A and bottom case 12B. Top case 12A and bottom case 12B may be formed from aluminum or other conductive materials. If antenna structures 20 were located within such conductive structures, proper antenna operation would be disrupted due to the electromagnetic shielding effects of the conductive sidewalls of base 12E.

With an arrangement of the type shown in FIG. 1 in which housing portion 25 is located between base 12E and display housing portion 12C, housing portion 25 may be formed from a dielectric. Typical dielectrics include glass, ceramic, rubber, and plastic. These are merely illustrative housing materials for housing portion 25. Any suitable materials may be used for housing portion 25 if desired.

By locating antenna structure 20 within a dielectric housing portion such as portion 25, the antenna resonating elements of device 10 are located at a sufficient distance from the metals and other conductive materials of housing base 12E and display housing portion 12D to ensure that the antennas in device 10 function properly. An advantage of locating antenna structure 20 and dielectric housing portion 25 on a portion of base housing 12E is that this helps to minimize the length of the transmission lines that are used to convey signals between radio-frequency transceiver circuitry (e.g., circuitry 18 of FIG. 1) and antenna structure 20, thereby helping to reduce signal losses. Arrangements of the type shown in FIG. 1 also help to avoid the need to pass radio-frequency transmission lines through a hinged portion of device 10 where they would be subject to twisting movement and possible mechanical failure.

Figure 3:
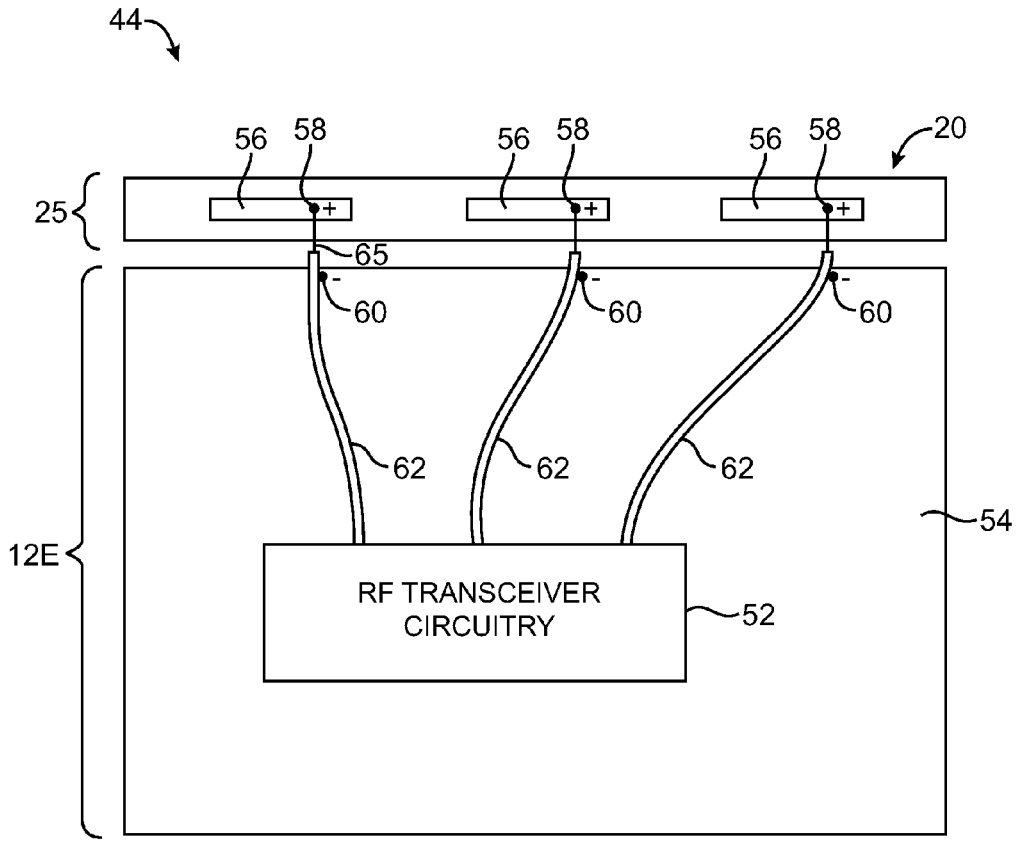
FIG. 3 is a diagram of illustrative antennas and radio-frequency transceiver circuitry in accordance with an embodiment of the present invention.

FIG. 3 shows a top view of an illustrative antenna structure 20 and portions of an associated device 10. As shown in FIG. 3, wireless communications devices 44 may include three antennas, each of which is formed from a respective antenna resonating element such as one of antenna resonating elements 56 and a common ground plane such as ground plane 54. Ground plane 54 may be formed from conductive structures associated with base 12E (i.e., top case 12A and the conductive structures mounted to and electrically connected to top case 12A). Antenna resonating elements 56 may be mounted on support structure 64 and may be formed from any suitable structures such as substantially planar conductive patterns of the type that are sometimes referred to as planar inverted-F antenna resonating elements or inverted-F antenna resonating elements.

As shown in FIG. 3, each antenna may be fed using a positive signal conductor (center conductor) 65 in a respective transmission line 62 that is connected to a respective positive antenna terminal 58 and a ground signal conductor in that transmission line 62 that is connected to a respective ground antenna terminal 60. If desired, matching networks may be used at the antenna feeds to help match the impedance of transmission lines paths 62 to the impedance of each antenna, to match a balanced transmission line to an unbalanced antenna, to match an unbalanced transmission line to a balanced antenna, etc. Tuning components may also be connected to the antennas (e.g., to portions of antenna resonating elements 58) to help tune the performance of the antennas. In the configuration of FIG. 3 in which antenna resonating elements are used with ground plane 54 to form inverted-F antennas that are fed using terminals 58 and 60, the antennas that are formed function as shunt-fed monopole antennas.

Radio-frequency transceiver circuitry 52 may include switches or passive signal combiners and dividers that allow one or more radio-frequency transmitters and receivers (sometimes referred to as radios) to be coupled to the antennas formed from antenna resonating elements 56. In the example of FIG. 3, there are three transmission lines 62 connected to radio-frequency transceiver circuitry 52 and three associated antennas in devices 44 each of which is formed from a respective antenna resonating element 56 and common ground plane 54. Antenna structure 20 of FIG. 3 may be formed in housing portion 25. Ground plane 54 may be formed from housing base 12E (e.g., housing portion 12A and/or 12B). In general, there may be any suitable number of antennas (one or more) in housing portion 25. The example of FIG. 3 is merely illustrative.

In the illustrative configuration of FIG. 3, the leftmost antenna and the rightmost antenna may be used to handle Wi-Fi signals (e.g., in the 2.4 GHz and 5.0 GHz bands). These two antennas may be used to implement an antenna diversity scheme. The center antenna of FIG. 3 may be used to handle Bluetooth® signals at 2.4 GHz or may be used to handle Wi-Fi communications at 2.4 GHz or 5.0 GHz (e.g., in a diversity scheme working in conjunction with the leftmost and rightmost antennas). In these illustrative arrangements, the antennas are multiband antennas or (in the case of a single-band Bluetooth antenna) a single band antenna. If desired, the antennas of antenna structure 20 may all be single band antennas, may all be multi-band antennas, or may include both single-band and multi-band antennas.

Figure 4:
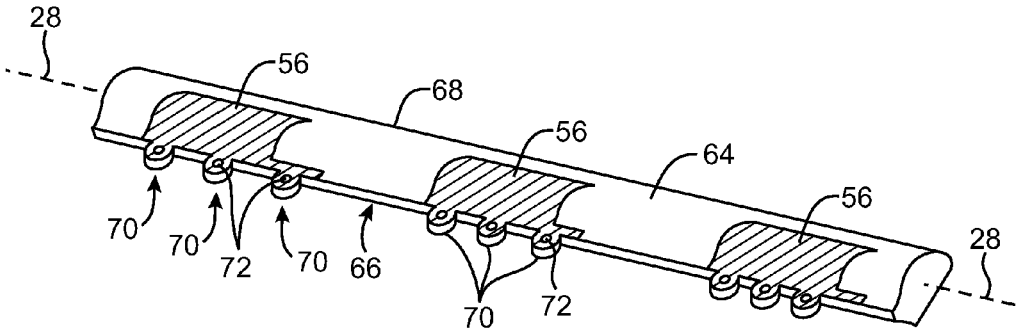
FIG. 4 is a perspective view of an illustrative set of antenna resonating elements supported by an antenna carrier in accordance with an embodiment of the present invention.

Antenna resonating elements 56 may be mounted on any suitable mounting structure. With one suitable arrangement, which is sometimes described herein as an example, antenna resonating elements 56 are formed from conductive traces on a dielectric support structure. As shown in FIG. 4, for example, antenna resonating elements 56 may be formed on a dielectric support structure such as dielectric support structure 64. The dielectric material of structure 64 may be a plastic. The dielectric support structure on which the antenna resonating elements are formed is sometimes referred to as an antenna carrier. A dielectric support structure such as structure 64 may be formed from one or more individual dielectric members. For ease of handing and to reduce complexity, it may be advantageous to use a single support member in forming support structure 64.

Support structure 64 may have a longitudinal axis that is aligned with longitudinal axis 28. In device 10, support structure 64 and resonating elements 56 may be mounted within housing portion 25 (FIG. 1). When mounted within device 10, edge 68 of support 64 may be aligned with the outermost edge of device 10, whereas edge 66 of support 64 and resonating elements 56 may be connected to ground plane 54 (e.g., a housing portion such as base 12E or, in particular, top case 12A). Screws or other suitable fasteners may be used to connect antenna resonating elements 56 to the ground plane (e.g., to the conductive housing). Antenna support structure 64 may be configured to form tabs 70 each of which has an associated screw hole 72 through which a screw or other fastener may be passed when affixing antenna support structure 64 and antenna resonating elements 56 to the ground plane formed by base 12E of housing 12.

Figure 5:
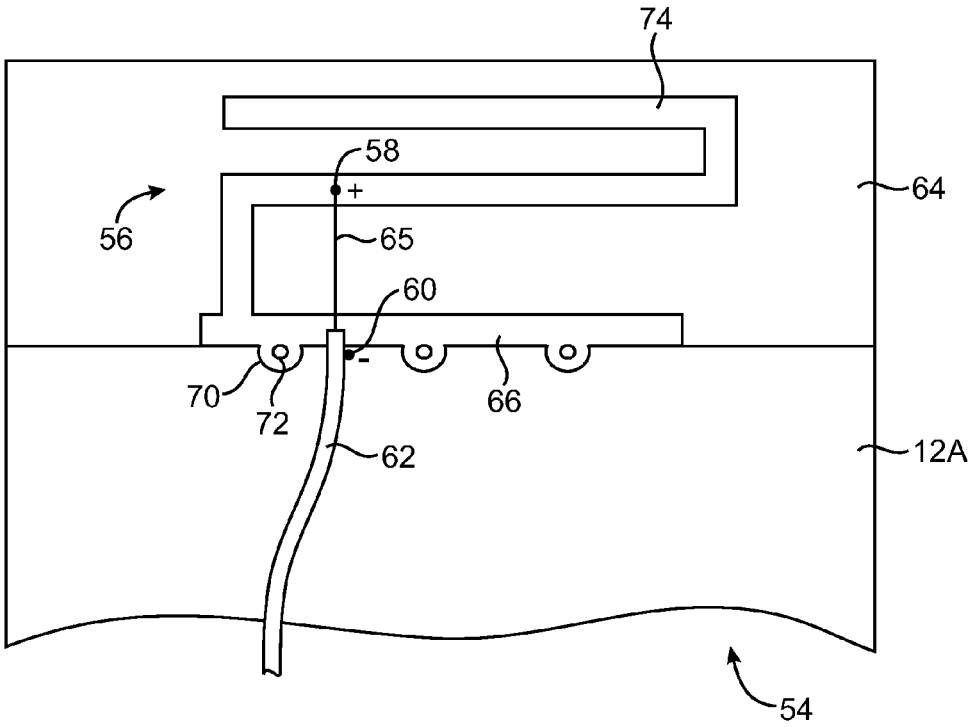
FIG. 5 is a schematic top view of an illustrative antenna in accordance with an embodiment of the present invention.

As shown in the illustrative configuration of FIG. 5, antenna resonating elements 56 may be formed from conductive traces such as trace 74. Antenna resonating element 56 may be electrically and mechanically attached to ground plane 54 by using screws or other fasteners in holes 72 to attach support 64 to housing portion 12A at edge 66.

The meandering conductive trace shape shown in the illustrative antenna resonating element 56 of FIG. 5 is merely illustrative. Antenna resonating elements 56 may have any suitable shape.

In general, the shape that is chosen for each antenna resonating element 56 may be determined based on the desired operating frequencies for the antennas of device 10. For example, in a dual-band antenna arrangement, it may be desirable to configure the shape of the antenna's resonating element 56 so that the antenna's fundamental operating frequency corresponds to a first frequency band of interest (e.g., 2.4 GHz) and so that the antenna's second harmonic operating frequency corresponds to a second frequency band of interest (e.g., 5.0 GHz). The antenna resonating element's length may be adjusted to be approximately equal to a quarter of a wavelength at the fundamental frequency. Bends, notches, protruding stubs, and other features may be incorporated into a given antenna resonating element to adjust its resonant frequencies and its bandwidth in each band of interest. As an example, folded shapes may be incorporated into the antenna resonating element. The folded shapes may help an antenna designer optimize antenna performance in situations in which it is desired to modify the frequency of the second harmonic resonance without significantly affecting the location of the fundamental antenna resonance. This is because folds may add reactances that affect the harmonic resonance more than the fundamental resonance. If desired, the length of an antenna fold may be adjusted to correspond to an additional secondary resonance that is configured to resonate in band.

When selecting a layout for a given antenna resonating element, it is also generally desirable to take into account the influence of structures that enclose the antenna resonating element (e.g., nearby conductive structures such as housing walls). The impact of nearby conductive structures can affect the frequency response of an antenna resonating element. An antenna resonating element will typically perform differently when mounted inside of an enclosure as opposed to being mounted in an unenclosed arrangement. This is because a given antenna resonating element will tend to excite resonances in its enclosure that are tuned via the antenna resonating element.

These techniques or other suitable techniques may be used to select a shape for an antenna resonating element that satisfies design goals (e.g., frequency band coverage, efficiency, etc.).

Figure 6:
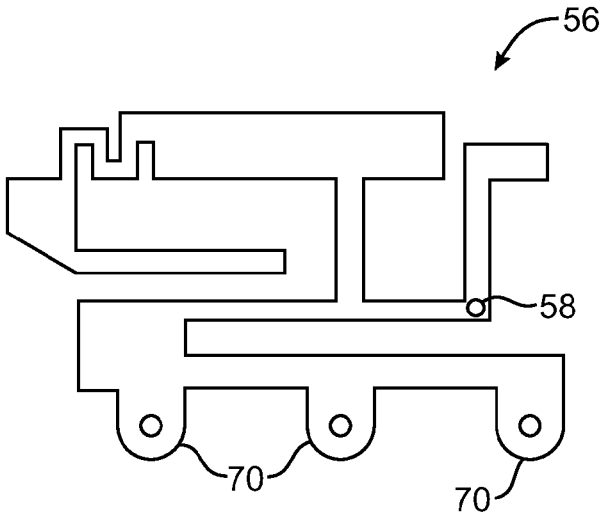
FIGS. 6-8 are illustrative patterns that may be used for antenna resonating elements in accordance with an embodiment of the present invention.
Figure 7:
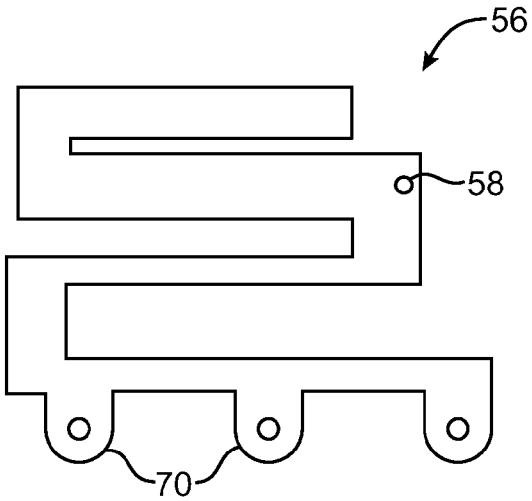
Figure 8:
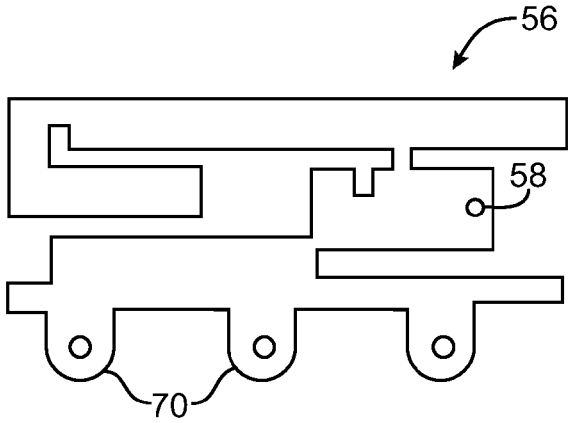

Examples of suitable patterns that may be used for the three antenna resonating elements 56 of FIG. 4 are shown respectively in FIGS. 6, 7, and 8. An advantage of using multiple tabs 72 along the edge of each antenna resonating element (e.g., three tabs 72 as in the examples of FIGS. 6, 7, and 8) is that this helps to promote formation of a low resistance path between the antenna resonating element and housing portion 12E.

Figure 9:
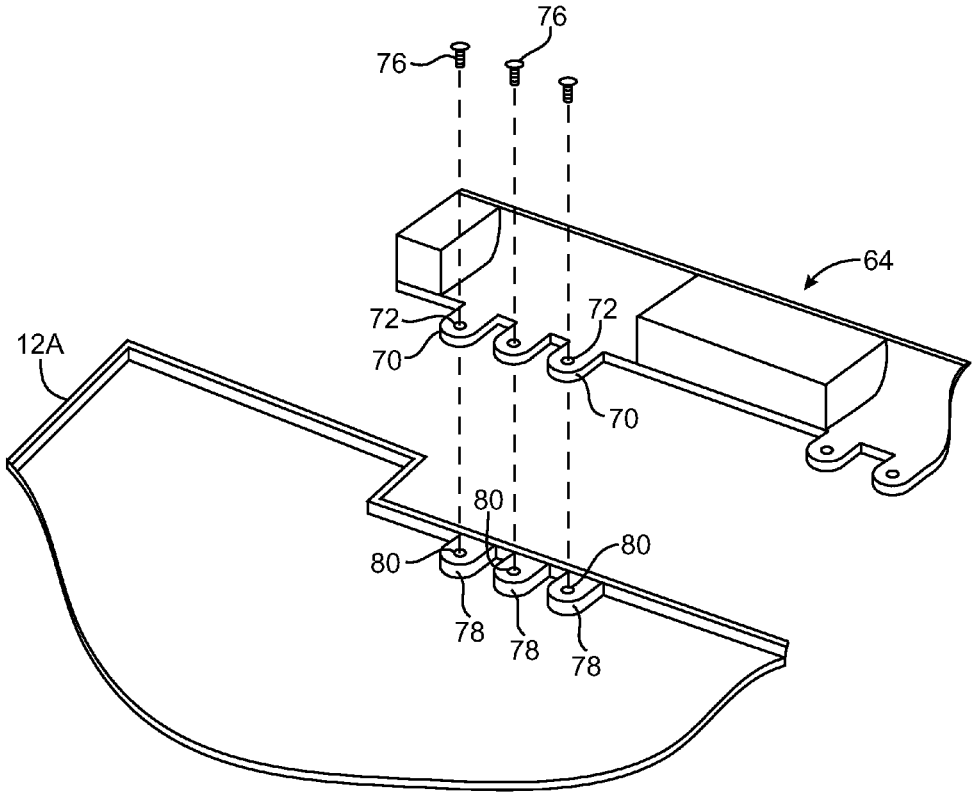
FIG. 9 is a perspective view of an antenna structure and an underside portion of a top of a base housing in accordance with an embodiment of the present invention.

A perspective view of the underside of an illustrative support structure 64 and top case 12A showing how support structure 64 and antenna resonating element 56 may be electrically and mechanically connected to top case 12A is shown in FIG. 9. As shown in FIG. 9, top case 12A may have tabs 78 with holes 80 that are aligned with corresponding tabs 70 and holes 72 on support structure 64. Screws 76 or other suitable fasteners may pass through holes 72 and 80. Nuts or threads in holes 80 may be used to secure screws 76.

Figure 10:
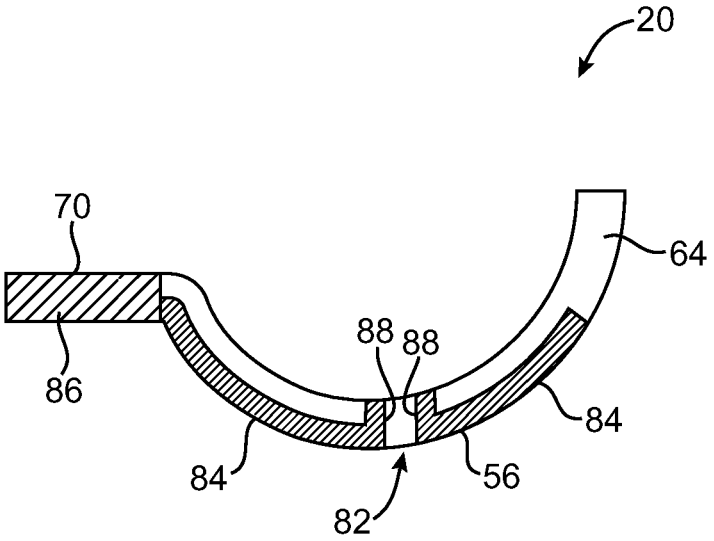
FIG. 10 is a cross-sectional side view of an antenna carrier and associated antenna resonating element mounted on the antenna carrier in accordance with an embodiment of the present invention.

A cross-sectional side view of an illustrative portion of antenna structure 20 is shown in FIG. 10. As shown in FIG. 10, antenna resonating elements such as antenna resonating element 56 may be formed from a conductive layer on dielectric support structure 64. Conductive layer portion 86 may coat dielectric portions of support structure 64 that are configured to form tabs 70. Conductive layer portions 84 may form substantially planar portions of resonating element 56 (e.g., using patterns of the types shown in FIGS. 6, 7, and 8). These substantially planar portions of antenna resonating element 56 may be curved along the arc defined by the semicircular cross-sectional shape of antenna support structure 64, as shown in FIG. 10. In the vicinity of positive antenna feed terminal 56, via 82 may be formed through support structure 64. The conductive layer of antenna resonating element 56 may have portions 88 that coat the inner sidewalls of via 82, thereby ensuring that molten solder will flow through via 82 when soldering center conductor 65 (FIG. 5) to antenna terminal 58 on the concave underside of antenna support structure 64.

Any suitable technique may be used to form conductive structures for antenna resonating element 56. For example, conductive structures for antenna resonating element 56 may be formed from stamped metal foil, flexible printed circuit board structures (e.g., polyimide-based structures of the type that are sometimes referred to as flex circuits), etc. With one suitable arrangement, antenna support structure 64 may be formed using a molded interconnect device (MID) manufacturing process such as a two-shot molded interconnect device process.

In a two-shot MID process, a plastic may be formulated to repel or attract conductive coatings by selective incorporation of chemical additives. When a first set of additives is incorporated into the plastic, the resulting formulation will attract conductive coatings. When a second set of additives is incorporated into the plastic, the plastic will repel conductive coatings. The different coating behaviors of these two types of plastic allow patterns to be defined for an antenna resonating element (i.e., by patterning the attractive plastic appropriately). An example of a conductive coating that may be used for coating portions of antenna support structure 64 is wet-plated copper. Other suitable coating materials include gold, chrome, nickel, tin, other suitable metals, alloys of these metals, etc. These materials may be deposited using electrochemical deposition (e.g., wet plating techniques) or other suitable techniques.

With a two-shot process, portions of antenna support structure 64 that are to be maintained free of conductor may be constructed from a first "shot" using a plastic blend that repels copper (or other conductor). Portions of MID antenna support structure 64 on which antenna resonating elements 56 are to be formed are constructed from a second "shot" using a plastic blend that attracts copper (or other conductor). During a subsequent plating process, only those portions of antenna support structure that were formed from the copper-attracting blend of plastic will be plated with copper. Portions of the antenna support structure that were formed from the copper-repelling blend of plastic will remain uncoated.

In the example of FIG. 10, the portions of antenna support structure 64 beneath the conductive layers that form antenna resonating element 56 are formed from a plastic blend that attracts copper (or other conductor), whereas the portions of antenna support structure 64 that are not covered by antenna resonating element 56 are formed from a plastic blend that repeals copper (or other conductor).

The two portions of the antenna support structure (i.e., the portion to be coated by conductor and the portion that remains uncoated) may be formed using separate MID tool pieces called cavities. In a two-shot process, two cavities are used. In general, any suitable number of shots may be used in forming antenna support structure 64. The use of a two-shot process is merely illustrative.

If desired, other techniques may be used for forming antenna support structures such as support structure 64. For example, a plastic having portions that are selectively activated by exposure to laser light may be used in forming the antenna support structure. The plastic may be, for example, a thermoplastic that has a organo-metallic additive that is sensitive to light at the wavelengths produced by a laser. The antenna resonating element pattern may be imposed on the plastic of the support structure by exposing the plastic to laser light only in areas in which conductive antenna structures are desired. After exposing desired portions of the plastic to laser light to activate those portions, the plastic may be plated with a suitable conductor such as copper. During plating operations, the laser-activated portions of the plastic attract the plating conductor (e.g., copper), thereby forming conductive antenna resonating element 56. Techniques in which laser light is used to imprint a desired plating pattern on a plastic support are sometimes referred to as laser direct structuring (LDS) techniques. Laser direct structuring services for forming molded interconnect devices in this way are available from LPKF Laser & Electronics AG of Garbsen, Germany.

In general, antenna resonating element structures may be formed on any suitable support structure. The foregoing examples, in which conductive antenna resonating element structures are formed by coating plastic support structures with patterns of metal (e.g., by plating) are merely illustrative.

Figure 11:
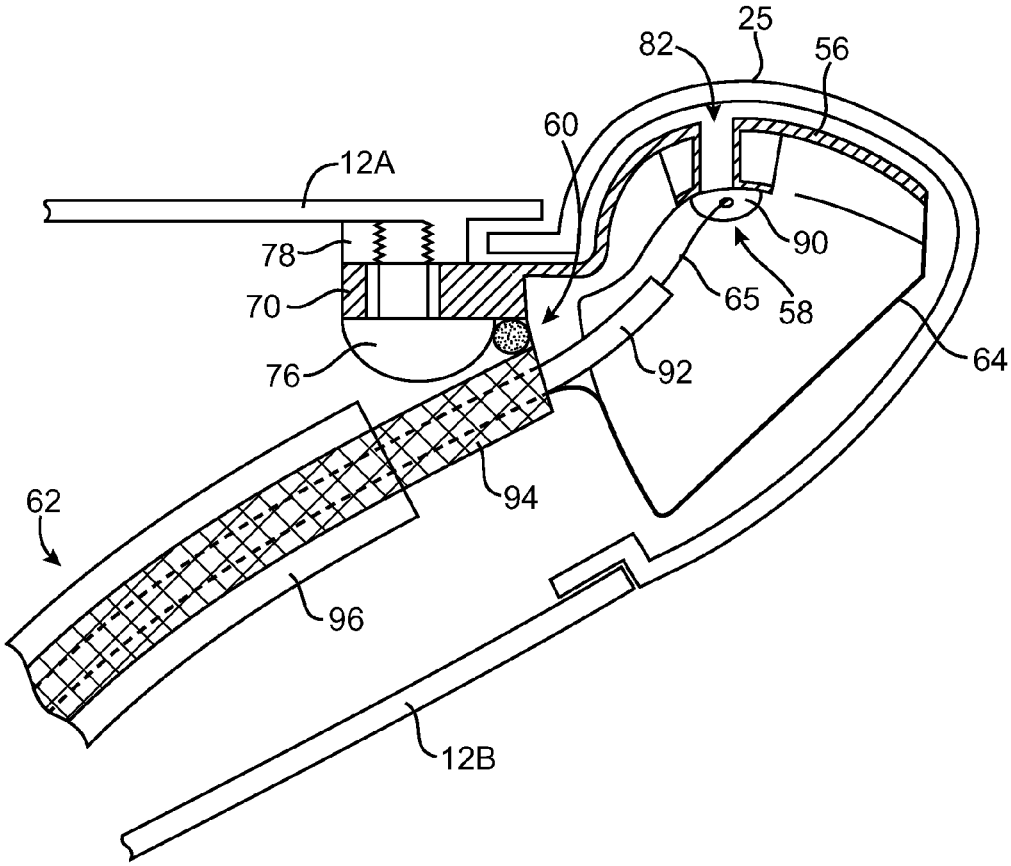
FIG. 11 is a cross-sectional side view of an antenna showing how a coaxial cable may be used to feed the antenna in accordance with an embodiment of the present invention.

A cross-sectional view of a portion of device 10 in the vicinity of housing portion 25 is shown in FIG. 11. As shown in FIG. 11, a coaxial cable or other suitable transmission line 62 may be used to feed the antenna formed from antenna resonating element 56 and the ground plane provided by housing portion 12A. Cable 62 may have an insulating jacket 96, a conductive braid that serves as ground conductor 94, dielectric core 92, and center conductor 65. At positive antenna feed terminal 58, the tip of center conductor 65 may be electrically connected to the portions of antenna resonating element 56 that coat the interior of via 82 using solder 90. Ground conductor 94 may be electrically connected to tab 70 at ground antenna terminal 60.

Any suitable attachment mechanism may be used when attaching ground conductor 94 of transmission line 62 to the portion of electrical conductor on tab 70. As an example, ground conductor 94 may be connected to tab 70 using solder, fasteners (e.g., screws), welding, etc.

Figure 12:
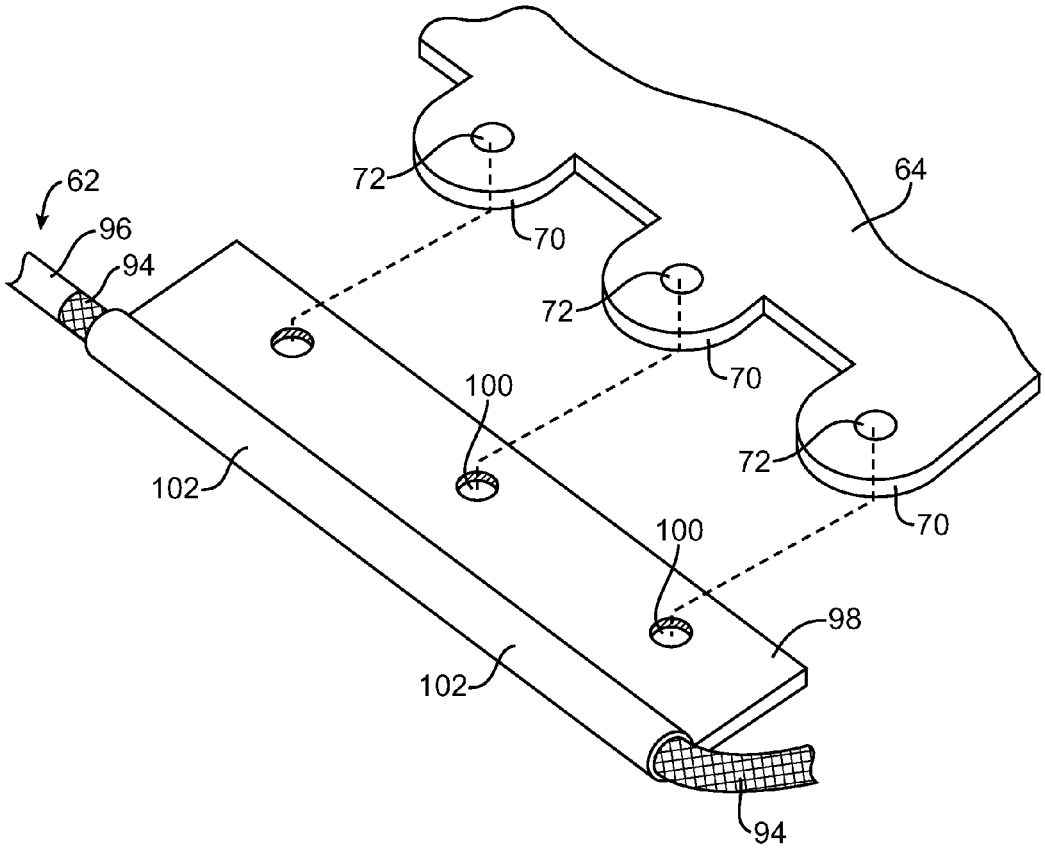
FIG. 12 is an exploded perspective view of a portion of an antenna resonating element formed on an antenna carrier and an associated grounding clip that may be used to electrically connect a ground conductor of a transmission line such as a coaxial cable to the base of the antenna resonating element in accordance with an embodiment of the present invention.

As shown in FIG. 12, a conductive structure such as clip 98 may be used to help electrically connect ground conductor 94 of transmission line 62 to tabs 70 on antenna support structure 64. Clip 98 may have holes 100 that are aligned with corresponding holes 72 on tabs 70. Clip 98 may be formed from any suitable conductor such as sheet metal. An example of a sheet metal that may be used for clip 98 is tin-plated cold rolled steel. Crimped portion 102 of clip 98 may be used to mechanically hold transmission line 62 in place.

Figure 13:
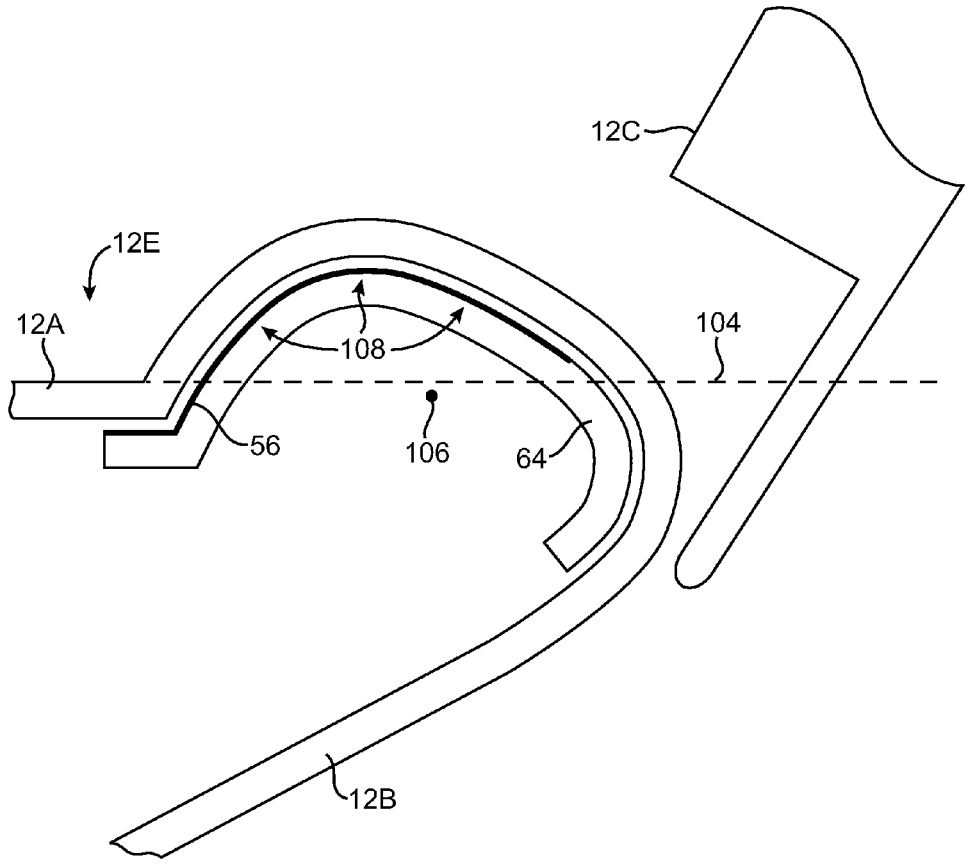
FIG. 13 is a cross-sectional side view of an illustrative portion of an antenna showing how the antenna resonating element of the antenna may protrude above a plane defined by an upper surface of a base portion of a portable computer or other electronic device in accordance with an embodiment of the present invention.

As shown in the cross-sectional view of FIG. 13, antenna support structure 64 may curve sufficiently to allow at least some of antenna resonating element 56 to protrude upwards from the top surface of base 12E. Top case portion 12A of housing 12 may have an upper surface that is aligned with plane 104. Display housing portion 12C may rotate about rotational axis 106 when the lid of device 10 is opened and closed. Plane 104 may, if desired, be located above rotational axis 106. At least in region 108, antenna resonating element 56 lies above plane 104 (and rotational axis 106). In this position, antenna resonating element 56 protrudes outwards from device 10 and away from housing surface 12A and the conductive portions of display housing portion 12C. Because antenna resonating element 56 protrudes away from the conductive housing structures of device 10, antenna resonating element 56 may exhibit good performance (e.g., by maintaining line-of-sight communications with wireless equipment such as accessories 46 and computing equipment 48 of FIG. 2).

The foregoing is merely illustrative of the principles of this invention and various modifications can be made by those skilled in the art without departing from the scope and spirit of the invention.

What is claimed is:

1. Antenna structures in the hinge of a laptop computer, comprising:

a singular antenna support structure in the hinge, wherein the singular antenna support structure comprises a dielectric antenna support structure; and at least first and second antenna elements mounted to the singular antenna support structure, wherein the first antenna element is of a type selected from the group of antenna types consisting of: a planar inverted-F antenna (PIFA) and an inverted-F antenna.

2. The antenna structures defined in claim 1 wherein the dielectric antenna support structure comprises a molded interconnect device dielectric antenna support structure.

3. The antenna structures defined in claim 2 wherein the first and second antenna elements comprise a conductive coating on the molded interconnect device dielectric antenna support structure.

4. The antenna structures defined in claim 2 wherein the molded interconnect device dielectric antenna support structure comprises a two-shot molded interconnect device antenna support structure.

5. The antenna structures defined in claim 2 wherein the molded interconnect device dielectric antenna support structure comprises a two-shot molded interconnect device antenna support structure having a portion that is coated with plated metal that forms the first and second antenna elements.

6. The antenna structures defined in claim 1 wherein the at least first and second antenna elements comprise at least three antenna elements mounted to the singular antenna support structure each of which forms a separate antenna.

7. The antenna structures defined in claim 1 wherein the at least first and second antenna elements comprise at least first and second multiband antennas.

8. The antenna structures defined in claim 1 wherein the first antenna element comprises at least a first conductive trace on the dielectric antenna support structure and wherein the second antenna element comprises at least a second conductive trace on the dielectric antenna support structure.

9. A laptop computer, comprising:

a hinge; and antenna structures comprising:

a singular antenna support structure in the hinge of the laptop computer; and at least first and second antenna elements mounted to the singular antenna support structure, wherein the hinge comprises a plastic hinge cover that surrounds the hinge, wherein the first and second antenna elements comprise flex circuits mounted within the plastic hinge cover, and wherein the flex circuits comprise conductive traces on a flex circuit substrate.

10. The laptop computer defined in claim 9 further comprising:

a conductive housing that forms an antenna ground plane associated with the first and second antenna elements.

11. The laptop computer defined in claim 9 further comprising:

a base housing; and a display housing that is connected to the base housing with at least the hinge.

12. The laptop computer defined in claim 11 wherein the singular antenna support structure is rigidly attached to the base housing.

13. The laptop computer defined in claim 9 wherein the singular antenna support structure comprises a molded interconnect device dielectric antenna support structure.

14. The laptop computer defined in claim 13 wherein the first and second antenna elements comprise a conductive coating on the molded interconnect device dielectric antenna support structure.

15. The laptop computer defined in claim 13 wherein the molded interconnect device dielectric antenna support structure comprises a two-shot molded interconnect device antenna support structure.

16. The laptop computer defined in claim 9 wherein the first and second antenna elements each comprise a plurality of conductive connections to a ground plane.

17. The laptop computer defined in claim 9 wherein the first and second antenna elements each comprise a plurality of conductive tabs that electrically ground that antenna element to a ground plane.

18. The laptop computer defined in claim 9 wherein the first and second antenna elements each comprise three conductive tabs that electrically ground that antenna element to a ground plane.

19. The laptop computer defined in claim 9 wherein the first antenna element has at least three parallel elongated conductive portions.

20. The laptop computer defined in claim 9 wherein the first antenna element has at least four parallel elongated conductive portions.

21. Antenna structures in a laptop computer having a hinge, comprising:

a singular antenna support structure in the hinge of the laptop computer; and at least first and second antenna elements mounted to the singular antenna support structure, wherein the hinge comprises a plastic hinge cover that surrounds the hinge, wherein the first and second antenna elements comprise flex circuits mounted within the plastic hinge cover, wherein the flex circuits comprise conductive traces on a flex circuit substrate, and wherein the first antenna element is of a type selected from the group of antenna types consisting of: a planar inverted-F antenna (PIFA) and an inverted-F antenna.

22. The antenna structures defined in claim 21 wherein the singular antenna support structure comprises a two-shot molded interconnect device dielectric antenna support structure.

23. The antenna structures defined in claim 22 wherein the first and second antenna elements comprise a conductive coating on the two-shot molded interconnect device dielectric antenna support structure and wherein the at least first and second antenna elements comprise at least first and second multiband antennas.

* * * * *